US006349860B1

(12) United States Patent
McMahon et al.

(10) Patent No.: US 6,349,860 B1
(45) Date of Patent: Feb. 26, 2002

(54) DISPENSING CAP HAVING SERUM TRAP

(75) Inventors: Mike McMahon, Bethel Park; Wayne Cleary, Glenshaw, both of PA (US)

(73) Assignee: H. J. Heinz Co., Pittsburgh, PA (US)

( * ) Notice: Subject to any disclaimer, the term of this patent is extended or adjusted under 35 U.S.C. 154(b) by 0 days.

(21) Appl. No.: 09/568,226

(22) Filed: May 9, 2000

(51) Int. Cl.[7] ..... B65D 47/00
(52) U.S. Cl. ..... 222/556; 222/547
(58) Field of Search ..... 222/547, 556, 222/568, 571

(56) References Cited

U.S. PATENT DOCUMENTS

| | | | | |
|---|---|---|---|---|
| 534,154 | A | | 2/1895 | Hooper |
| 1,050,192 | A | | 1/1913 | Wood |
| 2,782,966 | A | | 2/1957 | Wiedenmeier |
| 2,834,519 | A | | 5/1958 | Miller |
| 2,974,833 | A | | 3/1961 | Heppenstall |
| 3,100,067 | A | | 8/1963 | Heppenstall |
| 3,207,375 | A | | 9/1965 | Bereziat et al. |
| 3,233,798 | A | | 2/1966 | Abbott |
| 3,241,731 | A | | 3/1966 | Bright et al. |
| 3,318,496 | A | | 5/1967 | Ayotte et al. |
| 3,718,238 | A | * | 2/1973 | Hazard et al. ..... 222/556 |
| 4,494,682 | A | | 1/1985 | Beckstrom et al. |
| D363,222 | S | | 10/1995 | Lay |
| 5,524,788 | A | | 6/1996 | Plester |
| 5,642,824 | A | | 7/1997 | Hess, III et al. |
| D385,491 | S | | 10/1997 | Mueller et al. |
| 5,769,253 | A | | 6/1998 | Gross |
| 5,797,523 | A | | 8/1998 | Gross |
| D398,852 | S | | 9/1998 | Gross |
| 5,850,953 | A | | 12/1998 | Dallas, Jr. |
| 5,875,907 | A | | 3/1999 | Lay |
| 5,938,087 | A | | 8/1999 | Randall |
| 5,992,668 | A | | 11/1999 | Elliott |
| 6,003,728 | A | | 12/1999 | Elliott |
| 6,056,142 | A | | 5/2000 | Elliott |

* cited by examiner

*Primary Examiner*—David A. Scherbel
*Assistant Examiner*—Thach H. Bui
(74) *Attorney, Agent, or Firm*—Burns, Doane, Swecker & Mathis, LLP

(57) ABSTRACT

A dispensing cap for a container includes an internally screw-threaded skirt adapted to be screwed onto the externally threaded neck of the container. A transverse wall extends across the upper end of the skirt and includes a discharge hole extending coaxially with a center axis of the skirt. An annular abutment surface extends coaxially with the axis and is spaced downwardly from the transverse wall for abutting against a container rim. A tubular wall extends downwardly from a bottom surface of the transverse wall coaxially with the center axis for defining a downward extension of the discharge hole. The tubular wall is spaced radially inwardly of the abutment surface, whereby an annular serum trap is formed completely around the tubular wall and above the abutment surface.

15 Claims, 2 Drawing Sheets

FIG. 1
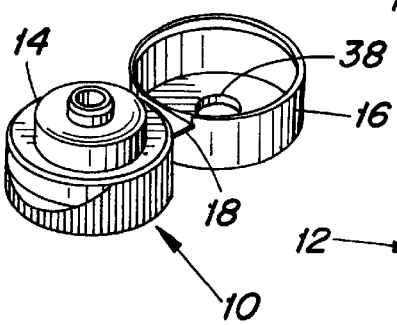
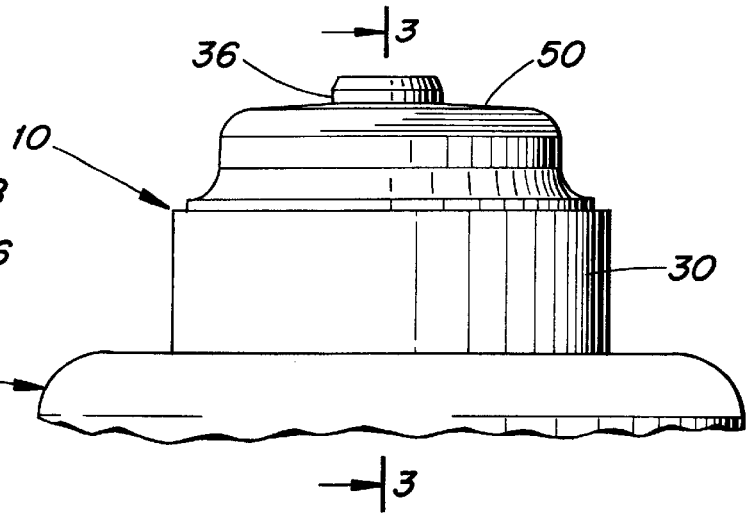
FIG. 2
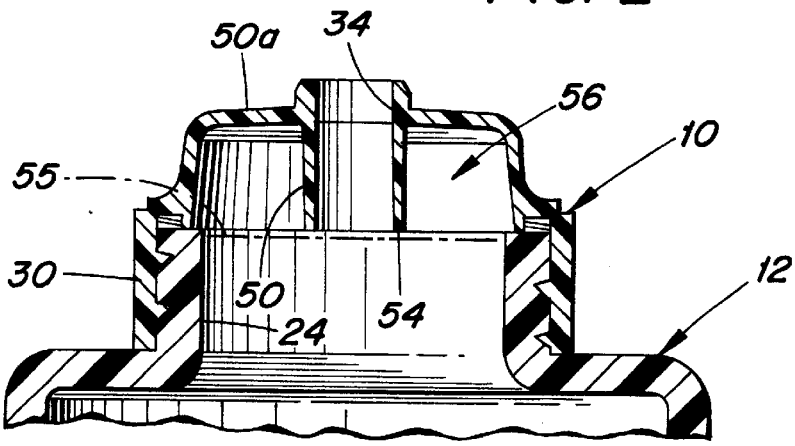
FIG. 3
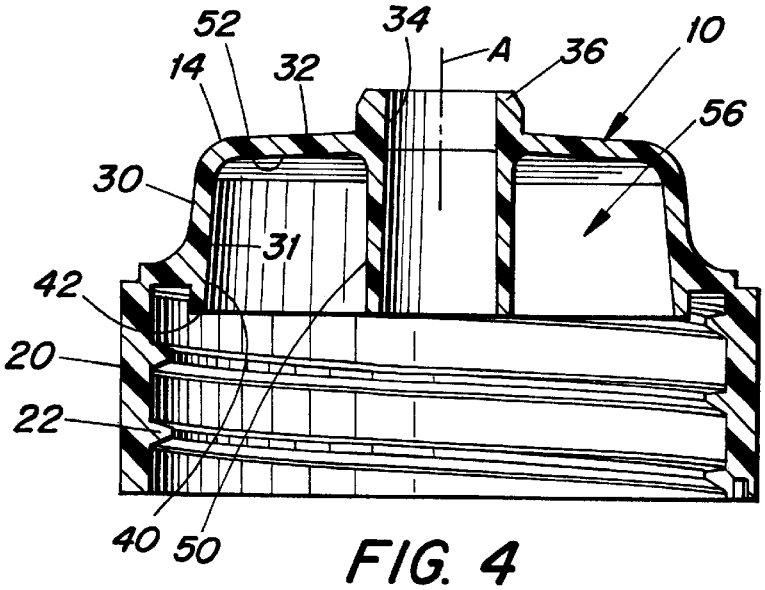
FIG. 4

DISPENSING CAP HAVING SERUM TRAP

BACKGROUND OF THE INVENTION

The present invention relates to dispensing caps for containers, especially to dispensing caps having a liquid trap for confining liquids that have been separated from a contained product.

Certain flowable food products such as ketchup and mustard are sold in containers having a dispensing cap, i.e., a cap with a dispensing hole formed therein, so that the flowable product can be dispensed through that hole by inverting the container. Food products of that type, especially ketchup and mustard, contain liquids such as water as an ingredient, and during periods of non-use, i.e., periods of non-dispensing, a liquid commonly referred to as "serum" tends to separate from, and collect atop, a solid portion of the product.

The serum is less viscous than the flowable solid portion, so that when a container possessing such collected serum is inverted to discharge the product, the serum will reach the discharge hole before the flowable solid. The resulting dispensing of serum is considered undesirable by consumers.

It has thus been proposed to provide a dispensing cap with a trap for confining the serum. For example, such a prior art dispensing cap 100 is schematically depicted as attached to a container 101 in accompanying FIG. 7. That cap 100 includes an internally threaded sleeve 102, a downwardly facing annular sealing surface 104, a transverse wall 106 closing an upper end of the sleeve, and an integrally hinged lid 107. The transverse wall includes a discharge hole 110 that is eccentrically arranged relative to a center axis A of the cap. A serum trap 112 is formed to one side of the hole 110. An inlet end of the hole 110 is coplanar with the sealing surface 104. An outlet end of the hole 110 is disposed below an upper surface 114 of the transverse wall 106.

The purpose of the serum trap 112 is to confine serum when the container is inverted. However, it can be seen that if the upper end of the container were tipped to the left in FIG. 7 (which is a natural direction of tipping), then due to the eccentric nature of the discharge hole 110, serum will flow towards and out the hole 110. On the other hand, if the upper end of the container were tipped to the right, then most of the serum would travel into the trap 112. However, in that case, when the product is discharged through the hole 110, it would flow along the upper surface 114 of the transverse wall 106, thereby messing that surface, as well as the lid 107.

It would, therefore, be desirable to provide a dispensing cap configured to prevent an appreciable discharge of serum during pouring, without resulting in a messing of the cap or lid.

SUMMARY OF THE INVENTION

The present invention relates to a dispensing cap for a container. The cap comprises a base which includes a cylindrical skirt defining a longitudinal axis and having a female screw thread formed on an internal surface thereof. The skirt includes upper and lower axially spaced ends. The lower end is open for receiving a mouth of a container. A transverse wall extends across the upper end of the skirt and includes a discharge hole extending coaxially with the center axis. An abutment surface extends coaxially with the center axis and is spaced downwardly from the transverse wall for abutting against a container rim to limit axial insertion of the closure thereon. A tubular wall extends downwardly from a bottom surface of the transverse wall coaxially with the center axis for defining a downward extension of the discharge hole. The tubular wall is spaced radially inwardly of the abutment surface, whereby an annular serum trap is formed completely around the tubular wall and above the abutment surface.

Preferably, the serum trap has a volume of at least two cubic centimeters. An upper outlet end of the discharge hole is preferably disposed higher than an upper surface of the transverse wall. Preferably, a lid is integrally hinged to the base and is movable to a closed position overlying the upper surface of the transverse wall to close the discharge hole.

Brief Description of the Drawings

The objects and advantages of the invention will become apparent from the following detailed description of preferred embodiments thereof in connection with the accompanying drawings in which like numerals designate like elements and in which:

FIG. 1 is a top perspective view of a dispensing cap according to the present invention;

FIG. 2 is a side elevational view of a base portion of the dispensing cap depicted in FIG. 1, the base being attached to the mouth of a container;

FIG. 3 is a sectional view taken along the line 3—3 in FIG. 2;

FIG. 4 is an enlarged sectional view similar to FIG. 3, with the base being detached from the container;

DETAILED DESCRIPTION OF PREFERRED

Embodiments of the Invention

Figure 5:
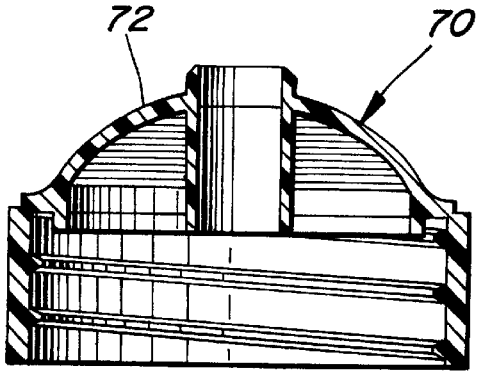
FIG. 5 is a sectional view through a second preferred embodiment of the invention.

Depicted in FIGS. 1–4 is a first embodiment of a dispensing cap 10 for a container 12 of the type which contains a flowable solid, such as ketchup or mustard, for example, wherein liquid (serum) tends to separate from the solid during periods of non-use.

The cap 10 is a one-piece element formed of plastic, such as a thermoplastic material, or other materials, compatible with the contained product. One preferred material is polypropylene. The cap 10 includes a base 14 and a lid 16 attached to the base 14 by an integral hinge 18. The lid can be of any suitable type and could be separate from the base instead of being integrally joined therewith. As can be seen in FIG. 4, the base 14 includes a cylindrical skirt 20 defining a longitudinal center axis A of the base. A female screw thread 22 is formed on a lower end of an interior surface of the skirt and is configured to threadingly mate with a male screw thread formed on a neck 24 of the container (see FIG. 3). The skirt includes upper and lower axially spaced ends, the lower end being open to receive the receptacle neck 24. The terms "upper" and "lower" as used herein are taken with reference to the container 12 being in an upright, non-pouring state.

An upper portion 30 of the skirt is stepped inwardly of the lower portion of the skirt, and includes an inner surface 31 facing radially inwardly, i.e., toward the center axis A, and transverse wall 32 extends from an upper end of the surface 31 and across the upper end of the skirt.

The transverse wall 32 is oriented perpendicular to the center axis A and includes a discharge hole 34 arranged coaxially with the center axis. An upper end of the discharge hole 34 is surrounded by a cylindrical wall 36 which projects above a plane of the transverse wall. That wall 36 is telescopingly received in a sleeve 38 formed on a bottom surface of the lid 16, when the lid is in a closed state.

An annular ridge 4 extends downwardly from a stepped portion of the skirt coaxially with respect to the axis A. The ridge 40 terminates in a downwardly facing sealing surface 42 which is spaced radially inwardly from the screw-threaded portion of the skirt and radially outwardly of the axis A.

A tubular wall 50 extends downwardly from a bottom surface 52 of the transverse wall 32 coaxially with the center axis A. The tubular wall 50 is spaced radially inwardly from the abutment surface 42 and terminates at a lower end located preferably at an elevation adjacent an elevation of the abutment surface and adjacent an elevation of an upper end of the female screw thread 22. In that regard, the tubular wall most preferably terminates at the same elevation as the abutment surface, whereby the inlet end 54 of the tubular wall 50 is coplanar with the abutment surface 42.

The inlet end should not extend beyond the plane of the abutment surface 42 if the container neck has a removable foil seal covering the mouth of the container, as shown in phantom lines 55 in FIG. 3.

It will be appreciated that an annular space 56 is formed completely around the tubular wall 50 and disposed above the elevation of the abutment surface 42, which space defines, as will be explained, a serum trap for confining serum during a pouring operation. As can be seen in FIG. 4, the serum trap extends unobstructedly in the radial direction from the tubular wall 50 to the inner surface 31 of the skirt.

The serum trap 56 has a volume of at least 2 cubic centimeters but, 3 or 4 or more cubic centimeters could be provided if desired.

In use, the container 12 is filled with a flowable solid such as ketchup or mustard, for example, and the cap 10 is screwed onto the container neck. If a removable foil seal 55 is to be provided, it is attached prior to insertion of the cap. During periods of non-use, serum tends to separate from, and float atop, the solid. When the user next performs a dispensing step by inverting the container, most of the serum flows rapidly downwardly into the serum trap 56 wherein it is confined, instead of flowing through the discharge hole 34.

When the slower-traveling solid reaches the inlet end 54 of the tubular wall 50, some of the solid will exit the container through the discharge hole 34, and some of the solid will flow into the serum trap 56, thereby displacing the serum. Since the displaced serum is now blocked by the solid from reaching the inlet of the tubular wall 50, the serum will tend to become re-absorbed by the solid.

Since the trap extends completely around the tubular wall 50, the container can be tilted in any desired direction to effect dispensing, without a risk of an appreciable amount of serum being discharged during pouring, and with minimal risk of the upper surface 50*a* of the wall 50 being significantly messed by the product.

That anti-messing feature is further ensured, because the serum trap is incorporated into the cap without causing any part of the transverse wall to be situated higher than an outlet end of the discharge hole 34. Thus, the dispensed solid will not tend to contact the upper surface 50*a* during pouring.

Figure 6:
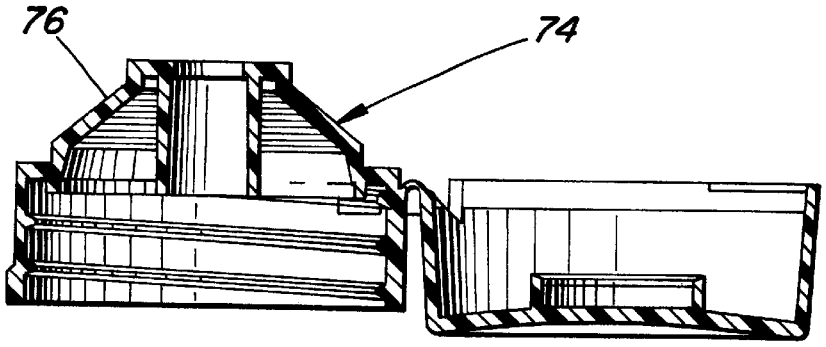
FIG. 6 is a sectional view through a third embodiment of the invention and depicting the integral hinged lid.
Figure 7:
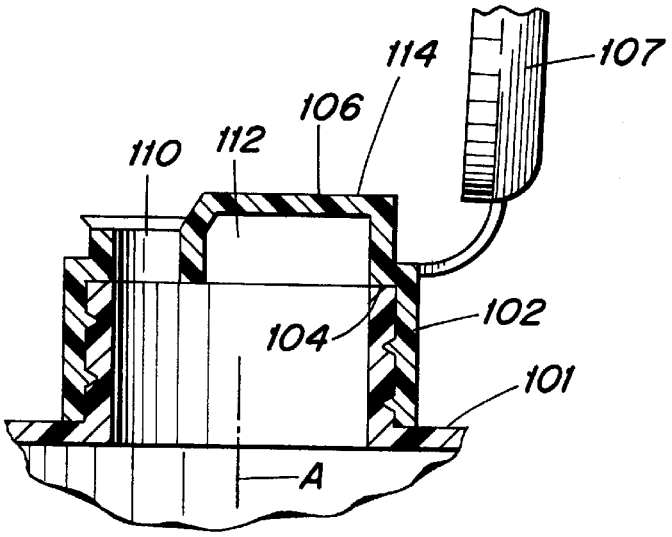
FIG. 7 (PRIOR ART)
FIG. 7 is a sectional view taken through a prior art dispensing lid attached to the mouth of a container.

The transverse wall need not be oriented exactly perpendicular to the axis A. In a first alternative embodiment of the invention, shown in FIG. 5, a cap 70 having a transverse wall 72 of generally dome shape is shown, and in a second alternative embodiment, shown in FIG. 6, a cap 74 having a transverse wall 76 of generally conical shape is shown.

Although the present invention has been described in connection with preferred embodiments thereof, it will be appreciated by those skilled in the art that additions, deletions, modification, and substitutions not specifically described may be made without departing from the spirit and scope of the invention as defined in the appended claims.

What is claimed is:

1. A dispensing cap for a container, comprising a base which includes:

a cylindrical skirt defining a longitudinal center axis and having a female screw thread formed on an internal surface thereof, the skirt including upper and lower axially spaced ends, the lower end being open for receiving a neck of a container, an upper portion of the skirt including an inner surface facing the axis;

a transverse wall extending across the upper end of the skirt and including a discharge hole extending substantially coaxially with the center axis;

an annular abutment surface extending coaxially with the center axis and spaced downwardly from the transverse wall for abutting against a container rim to limit axial insertion of the closure thereon, a lower end of the abutment surface lying in an imaginary plane oriented perpendicular to the center axis; and a tubular wall extending downwardly from a bottom surface of the transverse wall coaxially with the center axis for defining a downward extension of the discharge hole, the tubular wall being spaced inwardly from the abutment surface in a radial direction oriented perpendicular to the center axis, a lowermost end of the tubular wall lying substantially in the imaginary plane, wherein an annular serum trap is formed completely around the tubular wall and above the abutment surface and extending substantially unobstructedly in the radial direction from the tubular wall to the radially inwardly facing surface.

2. The cap according to claim 1 wherein the tubular wall terminates downwardly at an elevation adjacent an elevation of the abutment surface.

3. The cap according to claim 2 wherein a lower end of the tubular wall is substantially coplanar with the abutment surface.

4. The cap according to claim 1 wherein the screw thread terminates upwardly at an elevation adjacent the elevation of the abutment surface.

5. The cap according to claim 4 wherein the abutment surface is formed at a lower end of a cylindrical ridge extending downwardly from the transverse wall, the ridge spaced radially outwardly of the tubular wall and radially inwardly of the screw-threaded portion of the skirt.

6. The cap according to claim 5 wherein the serum trap has a volume of at least two cubic centimeters.

7. The cap according to claim 5 wherein the serum trap has a volume of at least three cubic centimeters.

8. The cap according to claim 1 wherein an upper outlet end of the discharge hole is disposed higher than an upper surface of the transverse wall.

9. The cap according to claim 1, further including a lid integrally hinged to the base and movable to a closed position overlying an upper surface of the transverse wall to close the discharge hole.

10. The cap according to claim 1 wherein the abutment surface is formed at a lower end of a cylindrical ridge extending downwardly from the transverse wall, the ridge spaced radially outwardly of the tubular wall and radially inwardly of the screw-threaded portion of the skirt.

11. The cap according to claim 1 wherein the serum trap has a volume of at least two cubic centimeters.

12. The cap according to claim 1 wherein the serum trap has a volume of at least three cubic centimeters.

13. The cap according to claim 1 wherein the cap is formed of plastic.

14. A dispensing cap for a container, comprising: a plastic base including:

a cylindrical skirt defining a longitudinal center axis and having a female screw thread formed on an internal surface thereof, the skirt including upper and lower axially spaced ends, the lower end being open for receiving a neck of a container, an upper portion of the skirt including a inner surface facing the center axis, a transverse wall extending across the upper end of the skirt and including a discharge hole extending coaxially with the center axis, an upper outlet end of the discharge hole disposed higher than an upper surface of the transverse wall, an annular abutment surface extending coaxially with the center axis and spaced downwardly from the transverse wall for abutting against a container rim to limit axial insertion of the closure thereon, and a tubular wall extending downwardly from a bottom surface of the transverse wall coaxially with the center axis for defining a downward extension of the discharge hole, the tubular wall being spaced inwardly from the abutment surface in a radial direction oriented perpendicular to the center axis, the tubular wall terminating downwardly at an elevation substantially corresponding to an elevation of the abutment surface, whereby an annular serum trap is formed completely around the tubular wall and above the abutment surface and extending substantially unobstructedly in the radial direction from the tubular wall to the inner surface of the skirt, the serum trap having a volume of at least two cubic centimeters; and a plastic lid integrally hinged to the base and movable to a closed position overlying the upper surface of the transverse wall to close the discharge hole.

15. The cap according to claim 14 wherein the abutment surface is formed at a lower end of a cylindrical ridge extending downwardly from the transverse wall, the ridge spaced radially outwardly of the tubular wall and radially inwardly of the screw-threaded portion of the skirt, the serum trap having a volume of at least three cubic centimeters.

* * * * *